United States Patent [19]

Matsui

[11] Patent Number: 4,768,679

[45] **Date of Patent: * Sep. 6, 1988**

[54] DISPENSING CONTAINER FOR PAPER TISSUES AND THE LIKE

[76] Inventor: Sumio Matsui, 5-7, Kitami 9-Chome, Setagaya-ku, Tokyo, Japan

[ * ] Notice: The portion of the term of this patent subsequent to Jul. 7, 2004 has been disclaimed.

[21] Appl. No.: 55,157

[22] Filed: May 28, 1987

Related U.S. Application Data

[63] Continuation of Ser. No. 783,342, Oct. 2, 1985, Pat. No. 4,678,099.

[30] Foreign Application Priority Data

Feb. 19, 1985 [JP] Japan ..... 60-29390
Aug. 29, 1985 [JP] Japan ..... 60-188504

[51] Int. Cl.[4] ..... B67H 1/00
[52] U.S. Cl. ..... 221/48; 221/55
[58] Field of Search ..... 221/47, 48, 52, 56, 221/63, 307, 308, 310, 303, 53, 55

[56] References Cited

U.S. PATENT DOCUMENTS 1,632,446 6/1927 Krueger ..... 221/53
1,744,644 1/1930 Krueger et al. ..... 221/48
2,323,395 7/1943 Harwood ..... 221/48
2,761,676 9/1956 Sabee et al. ..... 221/50
4,678,099 7/1987 Matsui ..... 221/48

FOREIGN PATENT DOCUMENTS 1112680 5/1968 United Kingdom ..... 221/63

*Primary Examiner*—H. Grant Skaggs
*Attorney, Agent, or Firm*—Charles E. Baxley

[57] ABSTRACT

A stack of folded and partially interleaved thin and soft sheets is held in a container such that the sheets can be drawn one at a time from the container. The container has a bottom formed with two pairs of opposing lower flexible lugs together defining a central discharge port and four blind extensions extending obliquely from opposite ends of the discharge port and having respective rounded ends. The flexibility of the lugs is such that on pulling of the lowermost sheet of the stack down through the port first the sheet flexes down one of the lugs of one of the pairs, then both lugs of the other pair, and finally the other lug of the one pair. Two pairs of opposite side have respective upper flexible lugs each extending the full width of the respective side and extending downward from the respective side toward the discharge port. The stack rests on all the upper flexible lugs. A rigid sheet can be held sheet in the fold of the uppermost sheet of the stack so that the uppermost sheet is securely held in the container until pulled therefrom.

4 Claims, 6 Drawing Sheets

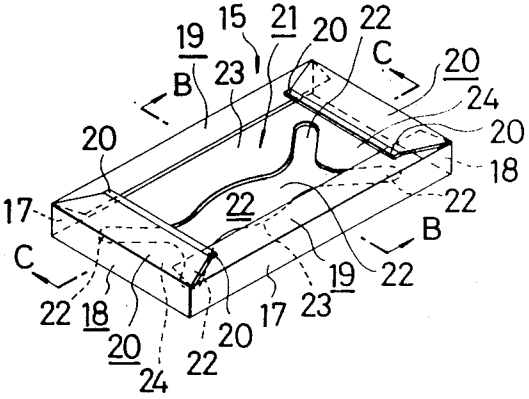
FIG. 2(A)
FIG. 2(B)
FIG. 2(C)
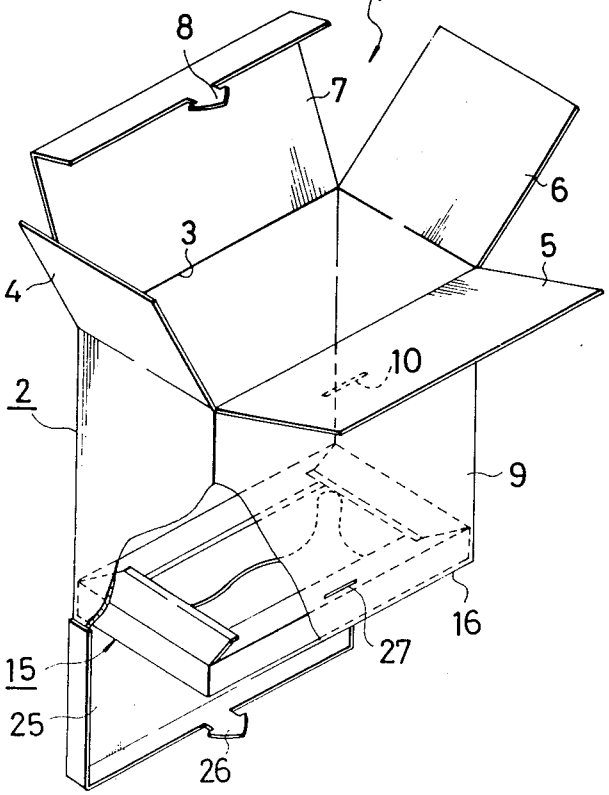
FIG. 1

DISPENSING CONTAINER FOR PAPER TISSUES AND THE LIKE

This is a continuation of application Ser. No. 783,342, filed Oct. 2, 1985 now U.S. Pat. No. 4,678,099.

BACKGROUND OF THE INVENTION

1. Field of the Invention

The present invention relates to a container for storing a stack of thin and soft sheets, such as tissue paper sheets, toilet paper sheets or paper towel sheets commonly used for household and hygienic uses. More particularly, the invention is directed to an improvement in sheet material dispenser means whereby sheets of paper or like materials are drawn out of the container readily and smoothly without being broken during the dispensing operation by a user, and the capacity of the container for storing sheet materials per unit volume can be increased.

2. Related Art Statement

In general, paper sheet materials used for hygienic uses, such as tissue paper, toilet paper or paper towels, are thin and soft, and have high water absorption coefficients and low tearing strengths. Such paper sheets are cut to have predetermined dimensions, folded in half, and then stacked in a container with the folded halves thereof inserted or tucked in the folded halves of the adjacent sheets. Most of the known containers for storing such a stack of paper sheets for hygienic or like uses have discharge or dispensing ports opening on the top walls thereof. However, when a paper sheet stack is contained in such a container having a dispensing port opening on the top wall, at least a portion of the paper sheet next to the sheet which has been or is just drawn out of the container must be pulled from the container to be ready for picking by the user's fingers, the portion of the next sheet being pulled out of the container by the accompanying movement thereof with the preceding sheet. With such a construction, the height of the container or the thickness of stacked and overlaid paper sheets should be less than the width of the folded and tucked section of each sheet, when it is desired to draw and consume all of the packed sheets including the last or lowermost paper sheet in a convenient manner. For this reason, the number of paper sheets which can be packed in a single container is limited. Another disadvantage of the conventional container of this type is that failure in pulling up the portion of the next sheet to the dispensing port occurs frequently to compel the user to insert his or her fingers deep into the container to draw up the paper sheets laid at the lower portion of the container.

There is also known a container for packing a paper sheet stack and having a dispensing port on the bottom wall thereof. A container of this type has the advantage that all of the paper sheets including the very last sheet can be dispensed from the container without any particular difficulty, since the paper sheets move spontaneously towards the bottom of the container by gravity as they are consumed. However, in the conventional container of this type, since the weight of all sheets stacked in the container is applied on the lowermost paper sheet to create excessive frictional force when the lowermost paper sheet is drawn through the dispensing port, a thin and soft sheet, such as tissue paper, having only limited low mechanical strength is apt to be broken during the pull-out operation especially when a large number of sheets is contained in the packed stack. Accordingly, the number of soft and thin sheets having relatively low strengths is also limited when they are packed in a conventional container of this type.

OBJECTS OF THE INVENTION

A primary object of this invention is to provide a novel dispensing container for holding a stack of thin and soft sheets, the container holding many more sheets than the prior-art such dispensing container and it being easy to pull sheets of the container without breakage.

Another object of this invention is to provide such a container for containing sheet a stack of thin and soft sheet sheets which may be easily and securely drawn from the container from the first sheet to the last sheet without a fear of breakage.

A further object of this invention is to provide such a container which can contain a larger number of thin and soft sheets than the number of same thickness and quality which are containable in the conventional container of same dimensions.

SUMMARY OF THE INVENTION

According to the invention a stack of folded and partially interleaved thin and soft sheets is held in a container such that the sheets can be drawn one at a time from the container. The container has a bottom formed with two pairs of opposing lower flexible lugs together defining a central discharge port and four blind extensions extending obliquely from opposite ends of the discharge port and having respective rounded ends. The flexibility of the lugs is such that on pulling of the lowermost sheet of the stack down through the port first the sheet flexes down one of the lugs of one of the pairs, then both lugs of the other pair, and finally the other lug of the one pair. Two pairs of opposite sides have respective upper flexible lugs each extending the full width of the respective side and extending downward from the respective side toward the discharge port. The stack rests on all the upper flexible lugs. A rigid sheet can be held sheet in the fold of the uppermost sheet of the stack so that the uppermost sheet is securely held in the container until pulled therefrom.

The discharge port is generally X-shaped and the sheets are folded with their folds extending parallel to a bisector of the port. The sheets are large enough, presuming them to be folded but flat, that they rest on the upper lugs and that the lower sheets in the stack at least are curved upwardly concave. In fact according to this invention the sheets when folded but flat are even larger than the area bounded between the sides so that it is impossible for the stack to lie in the container.

BRIEF DESCRIPTION OF THE DRAWINGS

FIG. 1 is a perspective view, partly broken away, of a first embodiment of the container of the invention with the top and bottom walls or lid portions opened;

FIG. 2(A) is a perspective view of the dispenser unit assembled in the container of FIG. 1, FIG. 2(B) is a sectional view taken along line B—B in FIG. 2(A), and FIG. 2(C) is a sectional view taken along line C—C in FIG. 2(A);

DESCRIPTION OF THE PREFERRED EMBODIMENTS

Figures 4A, 4B, 4C, 4D:
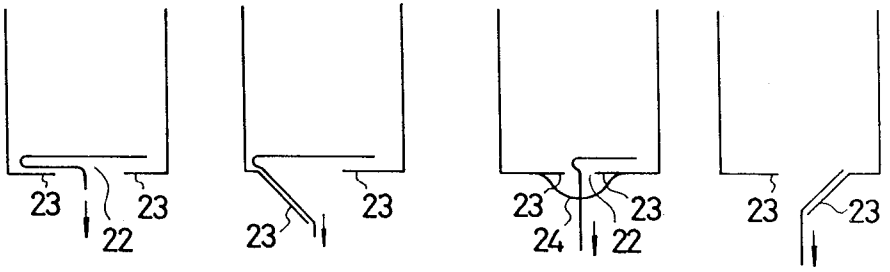
FIGS. 4(A), 4(B), 4(C), and 4(D) are mainly diagrammatic vertical cross sections through the dispenser according to this invention at successive stages on withdrawal of a sheet.
Figures 5A, 5B, 5C:
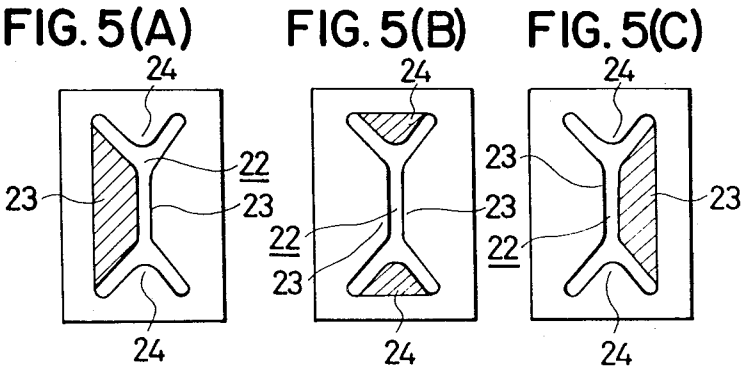
FIGS. 5(A), 5(B), and 5(C) are bottom views respectively corresponding to the stages shown in FIGS. 4(B), 4(C), and 4(D)

Referring first to FIGS. 1 to 5, an embodiment of the invention will be described. A container 1A shown in FIG. 1 is made of a durable and relatively light weight material, such as hard paper board or corrugated paper board, or plastics materials. The container 1A comprises a housing or casing 2 having a horizontal cross section of substantially rectangular shape. The housing 2 has an upper opening 3 defined by four peripheral edges from which flaps 4, 5, 6 and 7 extend integrally with the walls of the housing 2. When it is desired to close the opening 3, flaps 4 to 7 are folded to cover the opening 3 and a hook 8 provided at the free edge of the flap 7 is inserted into a hook receiving slot 10. The upper opening 3 is normally closed by the flaps 4 to 7 when the container is in use, and may be opened to receive therethrough supplemental sheet materials, such as paper tissues, in the housing 2.

Reference numeral 15 designates a dispenser unit disposed to cover the bottom opening 16 of the housing 2. Details of the dispenser unit 15 will now be described with reference to FIGS. 2(A) through 2(C). The dispenser unit 15 of this embodiment has a generally rectangular shape substantially coextensive with the interior contour of the bottom opening of the housing 2 so that it is snugly inserted in the housing 2. The dispenser unit 15 has opposing longitudinal walls 17, 17 and side walls 18, 18. The upper edges of the longitudinal walls 17, 17 are bent inward of the housing 2 to form a pair of flexible upper bolster members 19, 19, and likewise the upper edges of the side walls 18, 18 are bent inward of the housing 2 to form another pair of flexible upper bolster members 20, 20. The dispenser unit 15 has a bottom 21 which is cut to provide a discharge port 22 and to form four flexible lugs or segments 23, 23, 24, 24.

The flexible upper bolster members 19 and 20 are formed by bending the edges of the walls 17 and 18 so that the bent sections thereof extend substantially perpendicular to the upstanding wall portions, and the upper bolster pair 20 is supported by the upper bolster pair 19 extending along the longitudinal walls of the housing so that the resiliency and the weight bearing force thereof are enhanced. The side edges of the upper bolster 20 converge so that each of the upper bolster members 20 has a generally trapezoidal shape. With this shape, when the upper bolster pairs 19 and 20 are flexed downward by a sheet, the converging side edges of the bolster members 20 contact closely with the upper surface of the bolster members 19 to prevent the sheets getting caught in the gaps otherwise formed between the bolster members 19 and 20 to obviate the jamming problem.

As has been described hereinbefore, the bottom 21 is cut to provide the discharge port 22 which is formed of a center opening 22 extending along the longitudinal direction and four terminal channels 22 extending from the corners of the center opening 22 obliquely toward the corners of the bottom 21, whereby two pairs of opposing flexible segments or lugs 23 and 24 are formed to surround the discharge port 22.

Each of the upper bolster members 19 and 20 exerts a spring action against the downward gravitational force caused by the weight of a sheet material stack when it is flexed about the corresponding upper edge of the wall portion 17 or 18, so that the sheet material stack is resiliently supported thereby. Since the bottom 21 is also formed of a flexible material, each of the flexible lugs 23 and 24 bears the weight of the paper sheet stack indirectly, this being a secondary important function, similar to the function of each of the upper bolster members 19 and 20. The functions of the upper bolster members 19 and 20 and the functions of the lower flexible lugs 23, 24 will be described in detail hereinafter.

Now referring back to FIG. 1, reference numeral 25 designates a dressing cover hinged to the rear edge of the bottom opening 16 and having a front edge provided with a hook 26 which may be inserted into a hook receiving slot 27 to close the bottom opening 16 of the housing 2. By closing the bottom cover 25, the bottom opening 16 may be sealed to prevent dust from entering into the housing and to prevent damage of the container particularly during transportation. Needless to describe, since the mechanical strength of a housing is enhanced by closing all openings, rather than having one side or face left opened, the dressing cover 25 is provided to obviate breakage or damage of the container which otherwise might occur during transportation. Since the dressing cover 25 is generally dispensable when the container 1A is placed at a desired location, a perforation or the like is provided along the rear hinged edge of the cover 25 so that the dressing cover may be easily broken away from the housing 2 after its installation.

Meanwhile, although the housing 2 and the dispensing unit 15 are formed separately and then assembled in the embodiment illustrated hereinabove, they may be formed integrally from a sheet of hard paper board or like material.

Figure 3:
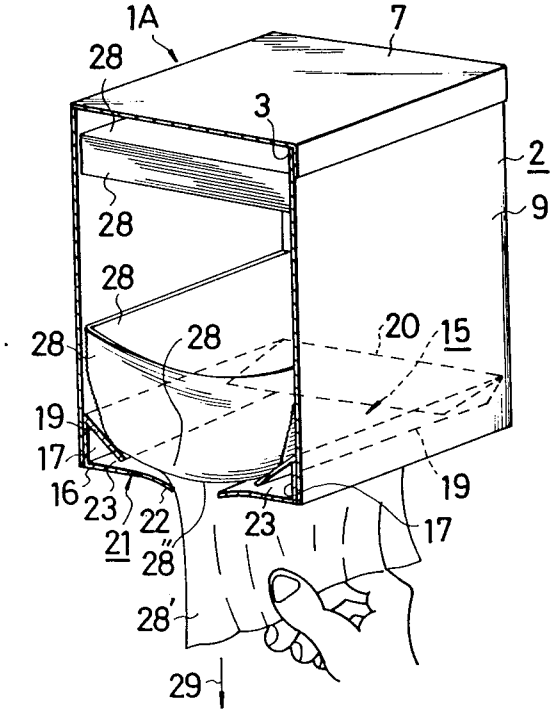
FIG. 3 is a perspective view, partly broken away, of the container of FIG. 1, showing a paper sheet contained in the housing of the container during the dispensing or drawing operation.

The operation of dispensing a sheet material from the sheet stack packed in the container 1A will now be described. In FIG. 3, reference numeral 28 designates a stack of tissue paper sheets which are piled in the housing 2 with their folded halves tucked in the overlapping folded portions of adjacent tissue paper sheets, the stack of tissue paper sheets being loaded into the housing 2 while keeping the flaps 4 to 7 in the open condition. In this Figure, tissue paper sheets forming the intermediate portion of the stack are omitted for simple illustration.

When a stack of tissue paper sheets 28 is contained to form a pile, the peripheral portions of the lowermost sheet are supported on the flexible upper bolster members 19 and 20 extending inward of the housing 2 with the central portion bent down. The central portion of the lowermost sheet contacts the bottom plate 21, whereupon the discharge port 22 is closed by the central portion of the warped sheet. As a result, the weight of the stack of tissue paper sheets is thus supported by the upper bolster pairs 19 and 20, with the central portion of the stack being supported by the bottom plate 21. Since the upper bolster members 19 and 20 and the flexible lugs 23 and 24 serve as resilient spring members, as described above, the biasing forces applied thereon due to gravitational force are resisted by the opposing forces exerted by these members.

As the peripheral portions of the lowermost sheet of the tissue paper stack are supported resiliently or flexibly by respective upper bolster members 19 and 20, the degree of downward warping of the central portion of each sheet increases as a specific sheet moves closer to the bottom, so that the area of the peripheral portions of respective sheets above the bolster members is decreased as they move downward with the contacting area of the lowermost sheet decreased to the minimum extent. As a result, the resistance to separation due to frictional force at the pull-out operation is minimized.

Moreover, as the result of flexible or resilient support of the peripheral portions of the paper sheet stack, the tissue paper sheets become loose as they move downward. This also contributes to a decrease in frictional force resisting pull-out of the lowermost sheet at the dispensing operation, and the tension otherwise concentrated locally in a small area on the lowermost sheet just being dispensed from the container is dispersed over and shared by the whole area of the sheet.

Furthermore, as the result of flexible or resilient support of the peripheral portions of the paper sheet stack, the direction of the force created by the gravitation or weight of the tissue paper stack, i.e. the force due to gravitation directed originally in the vertical direction, is redirected to an angle toward the discharge port 22.

It should be understood from the foregoing that the upper bolster members 19 and 20 exhibit advantageous functions to facilitate easy dispensing of the tissue paper sheet or sheets moved to the lowermost portion of the stack. The extremely favourable functions include the function of flexible or resilient support of the peripheral portions of the sheets, the function of decreasing the overlapping areas between the adjacent sheets at the peripheral portions, the function of decreasing the contacting area between the bolster members and the peripheral portions of the lowermost sheet, and the function of diverging the vertical force created by the weight of the stack of paper sheets into inclined directions.

Since the upper bolster members 19 and 20 are flexible, they are flexed by the action of the weight of the paper sheet stack so that the supporting faces thereof are inclined downwards in the directions towards the center of the sheet. As a result of such deflection or restorable deformation of the upper bolster members, paper sheets can be aligned in pertinent location as they are moved towards the discharge port even if some of them are dislocated at improper positions.

As will be apparent from the preceding explanations, the lowermost tissue paper sheet 28' of the tissue paper sheet stack 28 is smoothly drawn out of the container while being subjected to minimal stress by the overlapping sheets of the stack 28. In dispensing the lowermost sheet, the flexible lugs 23 and 24 surrounding the discharge port 22 on the bottom 21 exhibit the following functions:

FIG. 4(A) is a sectional view taken along the side walls of the housing of a container 1A in which a stack of tissue paper sheets 28 is contained. For simplicity of illustration, only one sheet, the lowermost sheet 28', is shown in this Figure and the following FIGS. 4(B) to 4(D). One end of the lowermost sheet 28' has been drawn through the discharge port 22 and extends downwards. As the end extending through the discharge port 22 is pulled downwards, the already projecting section of the folded sheet 28' urges the flexible lug or flexible segment denoted by oblique lines in FIG. 5(A) extending along the longitudinal direction to flex to enlarge the discharge port, as exaggeratedly shown in FIG. 4(B). As the sheet is drawn and the pulling force is transmitted to act directly on the folding line of the folded tissue paper sheet 28', the upper half of the folded sheet 28' is drawn until the point of pulling force application reaches the center of the upper half section, as shown in FIG. 4(C). At this stage, the flexed lug 23 is released from the downward urging force to be restored gradually, whereas the pair of flexible lugs 24 begins to be flexed. When the pulling force is applied on the substantial center of the sheet 28', the flexed lug 23 return to its starting position. As the tissue paper sheet 28' is pulled further, the other of the pair of flexible lugs 23, the lug or flexible segment denoted by oblique lines in FIG. 5(C) extending along the longitudinal direction opposite the other lug 23 begins to be flexed downwards. At this stage, the pair of flexible lugs 24 extending along the shorter side walls of the housing is restored gradually as the force applied thereon by the drawn sheet 28' is decreased. Then the upper half of the sheet 28' slidably moves along the flexed lug 23, as shown in FIG. 4(D), and finally the terminal end of the sheet 28' leaves the container to complete one cycle of the dispensing operation. Then, the other flexible lug 23 is restored.

The functions of the flexible lug pairs 23 and 24 will now be described while referring to interrelation of each lug with the other lugs.

Referring to FIG. 3, as the lowermost tissue paper sheet 28' is pulled, one of the pair of flexible lugs 23 is flexed depending on the pulling force applied on the drawn tissue paper sheet 28' (the pulling force being denoted by arrow 29 in the Figure), whereas the other flexible lugs 23, 24 and 24 are left unflexed since no pulling force is applied thereon. Meanwhile, the, major portion of the weight of the stack of tissue paper sheets 28—is carried by the unflexed lugs 23, 24 and 24, and a gap is formed between the lowermost sheet 28' and the tissue paper sheet 28'' next to the drawn sheet 28' as the one of the lugs 23 is flexed downwards so that the lowermost sheet 28' may be drawn through the discharge port 22 smoothly while being subjected to only a little loading caused by the weight of the overlapping tissue paper sheets 28. One half of the tissue paper sheet 28'' tucked between the lower and upper halves of the drawn sheet 28' accompanies the upper half of the sheet 28′ so that one end of the sheet 28″ protrudes through the discharge port 22 after the completion of dispensing of the lowermost sheet 28′.

Since the tissue paper sheets 28 are stacked with their lower folded halves tucked between the lower and upper halves of the preceding sheet, i.e. the lower adjacent sheet, and with their upper folded halves tucked in-between the next sheet, i.e. the upper adjacent sheet, in an alternate fashion, one end of the tissue paper sheet 28″ next to the lowermost tissue paper sheet 28′ is pulled out of the discharge port 22 so that the next sheet 28″ is drawn initially from the half supported by the other lug 23 (the right lug 23 as viewed in FIG. 3) which is opposing to the lug 23 (the left lug 23 as viewed in FIG. 3) initially flexed by the drawn sheet 28′.

As described hereinbefore, by the use of the embodiment of the container constructed in accordance with the invention, when a large number of thin and soft sheet materials, such as tissue paper sheets, is stacked therein, the entire weight of the overlaid sheets is carried by the obliquely flexed surfaces of four upper bolster members respectively projecting inwards from four walls of the container housing, whereby the central portions of stacked paper sheets are warped increasingly as they move downwards in the container housing so that the paper sheets located in the lower portion of the stack become loose and the areas of peripheral portions thereof supported by respective bolster members are decreased as they move downwards, and the loading force originally created by the weight or gravitational force of the overlapping sheets in vertical direction is applied on a sheet in the lower portion of the stack as diverging forces inclined from the vertical direction. Moreover, the flexible lugs or segments surrounding the discharge port are successively flexed downward to provide a gap between the lowermost sheet and the sheet next to the lowermost sheet during the dispensing operation of the lowermost sheet so that the loading applied on the sheet just being pulled out of the container is reduced to decrease the frictional force to facilitate easy dispensing of the lowermost sheet while minimizing the fear of breakdown.

By the use of the container, according to the invention, with the construction as aforementioned, the lowermost sheet can be drawn out easily without the fear of tearing or other damages. Accordingly, a large number of overlapping sheets may be stacked and contained in the container of the invention to satisfy the needs arising depending on the applied uses, the set position, expected number of users and the frequency in consuming the content sheets in the container.

A large number of sheets thus stored in the container is successively dispensed from the bottom with the remainder of the contained sheet materials moving spontaneously by gravitational force so that all sheets including the last sheet may be securely and easily dispensed from the container. Supplemental sheets may be, of course, supplied through the upper opening of the container housing at any time as necessity arises.

Although tissue paper sheets have been charged in the housing of the container 1A in the foregoing description of the first embodiment of the invention, the container may be charged with any thin and soft sheet materials, particularly used for hygienic applications, the examples being toilet paper, makeup paper and paper towels. The container 1A, constructed in accordance with the invention, may be used for household uses and for business uses in offices, hotels and restaurants.

A soft and thin sheet material of continuous long sheet form, other than the cut and folded pile as shown in FIG. 3, may be contained in the container of the invention merely by folding the continuous web of such a material.

Figure 6:
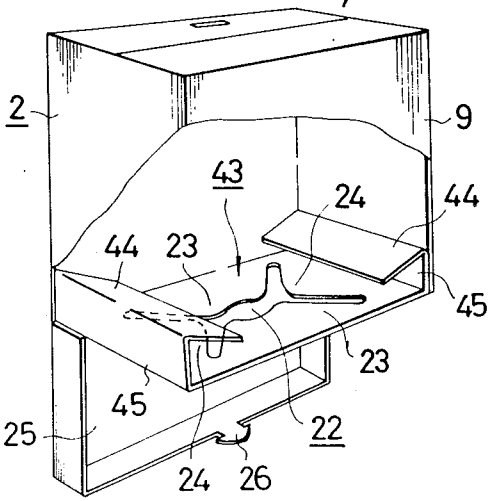
FIG. 6 is a perspective view, partly broken away, of another embodiment of the container of the invention with the top and bottom walls or lid portions opened.

FIG. 6 shows a second embodiment of the container of the invention for containing thin and soft sheets. The only difference between this embodiment and the first embodiment shown in FIG. 1 is that the upper bolster members in the container 1A of the first embodiment are replaced by distinctive upper bolster members in the container 1B of this embodiment. Accordingly, the container 1B will be described hereinbelow simply by omitting repeated description of the parts that are the same as those of the container 1A.

Referring to FIG. 6, a dispenser unit 43 has a pair of upper bloster members 44 and 44 and a bottom plate section formed with flexible lugs or segments 23, 23, 24 and 24, and the upper bolster members and the bottom plate section are formed of a single flexible plate. In detail, both ends of a generally rectangular piece of cardboard are bent to form upper flexible bolster members or lugs 44, 44, and the portions adjacent to the flexible lugs 44, 44 are bent to form auxiliary side walls 45, 45, the remaining generally rectangular center section of the piece of cardboard having dimensions snugly fitted and fixed to the lower opening of a housing 2. The center section is provided with a discharge port 22 which is defined and surrounded by lower flexible lugs 23, 23, 24 and 24. The thus formed dispenser unit 43 is fitted and fixed in the housing 2 at a position adjacent to the lower opening by securing the auxiliary walls 45 and 45 to the side walls of the housing 2 by an adhesive. Meantime, the container 1B, according to this embodiment of the invention, may be assembled from a separate housing 2 and dispenser unit 43 as described above, or alternatively a sheet of paper board may be punched to have an appropriate shape followed by bending to form the desired container.

With the upper flexible bolster members 44, 44 and the lower flexible lug pairs 23 and 24 exhibiting the same functions as those of the upper flexible bolster members 20, 20 and the lower flexible lugs pairs 23, 23 and 24, 24, the tissue paper sheets contained in the container 1B can be easily dispensed therefrom, in addition to a further advantage that the container 1B can be manufactured very simply at a low cost.

Figure 7:
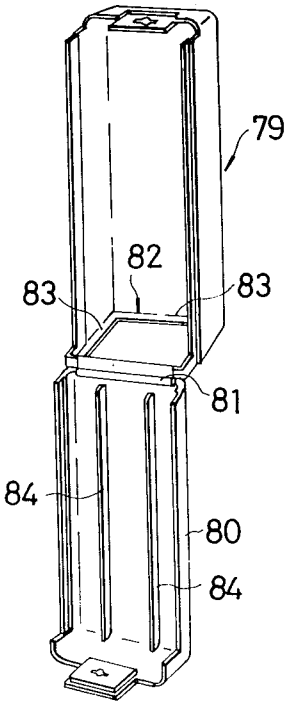
FIG. 7 is a perspective view showing a housing of the container according to a further embodiment of the invention.

A further embodiment of the container for containing a stack of thin and soft sheet materials, according to the invention, may be the combination of a casing shown in FIG. 7 with any one of the dispenser units shown in FIGS. 8 to 10.

The casing 79 shown in FIG. 7 is made of synthetic resin having a front opening as shown in the Figure, and a cover 80 is attached thereto by hinge means 81 disposed at the lower end edge of the casing 79 to be opened or fixed to a closing position. The bottom 82 of the casing 79 is cut away while leaving peripheral frame or rims 83. Two parallel ribs 84 extend on the inner face of the cover 80 substantially along the entire longitudinal length of the cover 80. These ribs are provided for restraining or pressing one edge of stacked sheet materials, such as tissue paper or toilet paper sheets, onto the opposing rear wall of the casing 79 when the latter is closed by the cover 80 so as to prevent dislocation of sheet materials. Any one of the following dispesnser units may be placed on the rims or framework 83 at the bottom 82 of the casing 79.

Figure 8A:
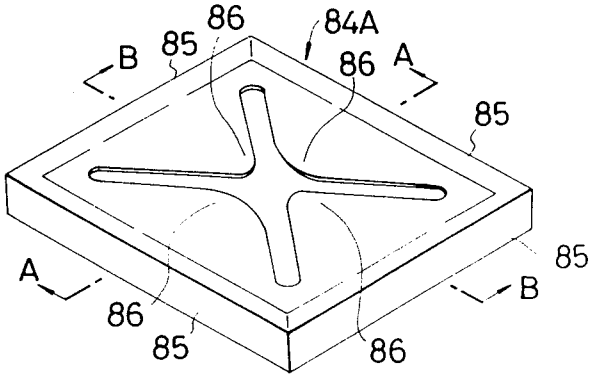
FIGS. 8(A), 9(A), and 10(A) are perspective views of bottom plates usable in the dispenser of FIG. 7.
Figure 8B:
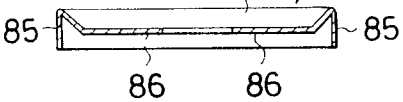
FIGS. 8(B), 9(B), and 10(B) are sections taken along lines A—A of respective FIGS. 8(A), 9(A), and 10(A)
Figure 8C:
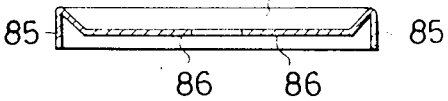
FIGS. 8(C), 9(C), and 10(C) are sections taken along lines B—B of respective FIGS. 8(A), 9(A), and 10(A)

The unit shown in FIGS. 8(A) through 8(C) is an embodiment of the dispenser unit which may be assembled in the aforementioned casing 79. In the dispenser unit 84A shown in FIGS. 8(A) through 8(C), two pairs of flexible lugs or segments 86 are provided in a coplanar plate, each pair of lugs 86, 86 being of tongue like shape extending from the inner peripheral edges of the generally rectangular frame 85.

Figure 9A:
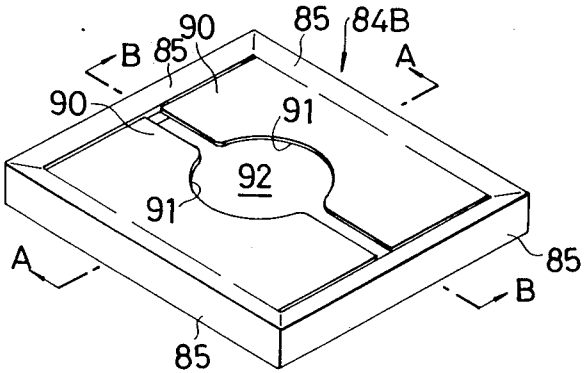
Figure 9B:
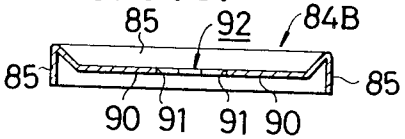
Figure 9C:
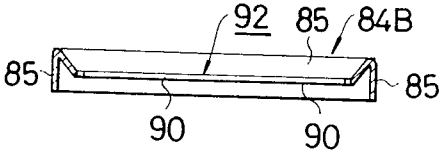

FIGS. 9(A) through 9(C) show another embodiment of the dispenser unit which may be assembled in the casing 79. The dispenser unit 84B shown in FIG. 9 is provided with a pair of opposing flexible segments or lugs 90 in the same plane. Each of the opposing flexible segments 90 has a generally rectangular shape and extends from the edge of one longitudinal periphery of a rectangular frame 85 with the center portion 91 cut away to form a generally semicircular opening. A paper sheet dispensing port 92 is defined by a zone surrounded by the semicircular cut-away portions 91 of the opposing segments 90 and the slots or gaps between the opposing segments 90.

Figure 10A:
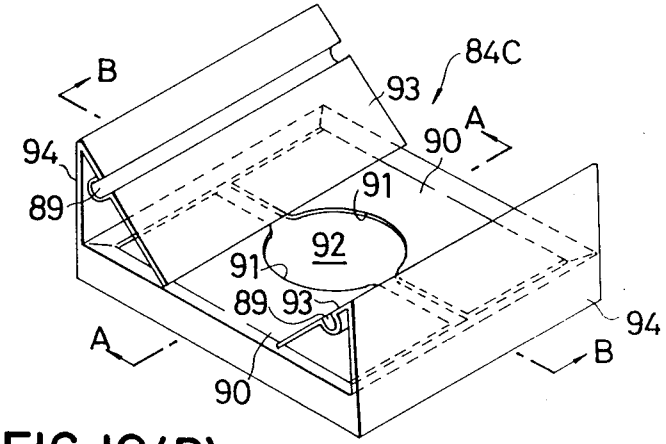
Figure 10B:
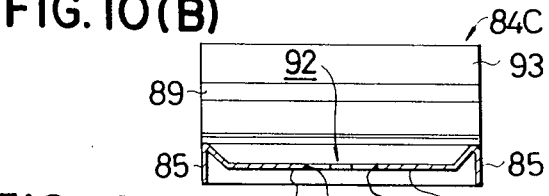
Figure 10C:
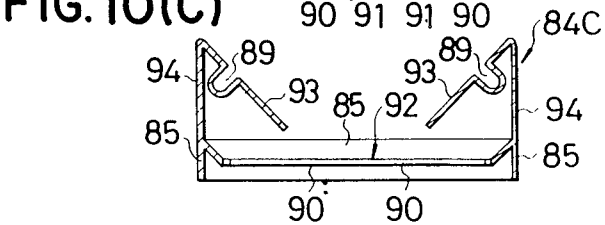

FIGS. 10(A) through 10(C) show a further embodiment of the dispenser unit which may be assembled in the casing 79. The dispenser unit 84C shown in FIGS. 10(A) through 10(C) is provided with an additional pair of opposing segments 93 and 93 above a similar construction to that of the dispenser unit 84B shown in FIGS. 9(A) through 9(C). The pair of upper flexible segments 93 and 93, which serve as upper bolster members, extends obliquely in downward directions from each upper edge of the opposing side walls 94 and 94 standing away from the walls other than those from which the lower flexible lugs 90, 90 extend. The free end of each upper bolster member 93 crosses each of the lower flexible lugs 90 at a right angle. Each of the upper bolster members 93, 93 is provided with a transverse ridge 89 formed by crimping the bolster member. The transverse ridge 89 is provided to increase the flexibility and restoring force of the upper bolster member 93.

Any one of the dispenser units 84A, 84B and 84C may be placed on the framework 83 on the bottom 82 of the casing 79 to form a container.

All of the aforementioned dispenser units 84A, 84B and 84C provide similar remarkable effects as obtainable by the first embodiment shown in FIG. 1.

Figure 11:
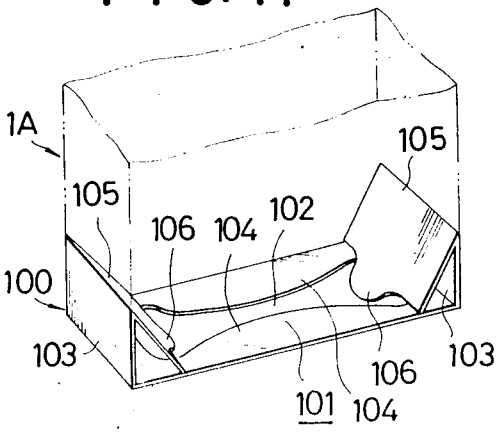
FIG. 11 is a perspective view showing another bottom plate usable with the housing of the container shown in FIG. 1.

FIG. 11 shows another form of the dispenser unit, according to the invention, assembled with the container 1A of FIG. 1. In this embodiment, a bottom plate 101 has an opening 102 extending longitudinally at the center region of the plate 101, the width of the opening 102 being enlarged as it approaches to the side walls 103 and 103, so that a pair of opposing flexible lugs 104 and 104 is formed along the longitudinal edges of the opening 102. The upper portions of side walls 103 and 103 are bent to form upper flexible bolster members 105 and 105. Each of the upper flexible bolster members 105 and 105 has a tip end 106 which forms a projection to be inserted through the widened region of the opening 102. Since each upper flexible bolster members 105 is inclined downwards as shown in FIG. 11, the projection 106 thereof extends obliquely beyond the bottom of the container 1A.

By the use of the dispenser unit of this embodiment having a pair of opposing upper flexible bolster members 105 and 105 which have no stepwise change along the guiding face and are inclined downwards with their projecting tip ends extending through the discharge opening 102, tissue paper sheets contained therein can be guided very smoothly to be dispensed easily. Since the major portion of the weight of the sheet material stack is loaded on and supported by the upper flexible bolster members 105 and 105, the frictional force between the sheet drawn from the container and the lower flexible lugs 104 and 104 is reduced to a minimal extent to facilitate easier dispensing thereof.

Figure 12:
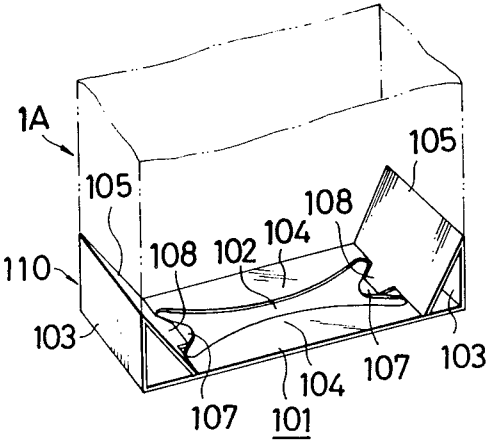
FIG. 12 is a perspective view showing a further bottom plate usable with the housing of the container shown in FIG. 1.

FIG. 12 shows a modified embodiment 110 of the dispenser unit as shown in FIG. 11. Since this embodiment has a similar construction and a number of the same parts or portions as in the embodiment of FIG. 11, only the distinctive portions and functions thereof will be described. The dispenser 100 shown in FIG. 11 has the opening 102 defined or surrouded by a single pair of lower flexible lugs 104 and 104, whereas an additional pair of opposing lower flexible lugs 107 and 107 is provided radially perpendicular to the lugs 104 extending in the longitudinal direction. In this modified embodiment, the projecting tip ends 108 of the upper bolster members 105 are truncated and the truncated ends are placed on the corresponding lugs 107 of the lower flexible lugs 107 so that the lower flexible lugs 107 are pushed downwards in the inclined directions. When a sheet of tissue paper is dispensed from the container of this embodiment, it is guided by the upper bolster members 105 and 105 until it is moved close to the opening 102 with the lower flexible lugs 107 and 107 inclined for guiding beyond the opening 102, whereby the tissue paper sheet can be drawn very smoothly.

Figure 13:
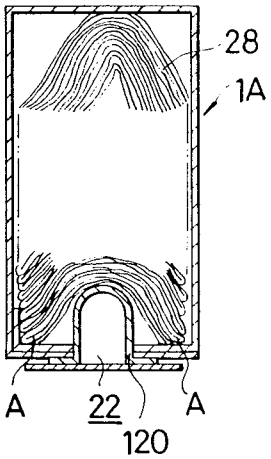
FIG. 13 is a schematic illustration showing the stack of sheet materials, in section, packed in a container.
Figure 14:
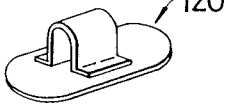
FIG. 14 is a perspective view showing a holder, according to the invention, adapted to be attached to the bottom of the container shown in FIG. 13.

FIG. 13 shows another embodiment of the container housing 1A which has a narrower width for adapting to contain a stack of tissue paper sheets 28 with the central zone raised upwards. In this embodiment, a significant fraction of the weight of the sheet material stack is applied concentratedly on the areas A, A at the vicinities of the peripheral portions of the bottom plate close to the side walls, whereby the loads applied on the lower flexible lugs 23, 23, 24, 24 are considerably reduced. As a result, the fear of tearing or breaking of weak tissue paper or other sheet materials due to the frictional force at the pulling out operation can be obviated. With a holder 120 being in the opening 22, as shown in FIG. 14, the sheet material stack may be held in the condition with the center portion held in a raised contour prior to use.

Figure 15:
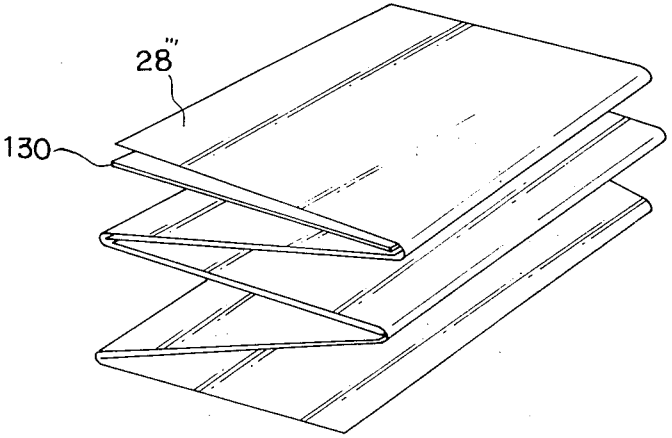
FIG. 15 is a perspective view of a relatively rigid sheet inserted in the fold of the uppermost sheet of the stack of soft sheets.

As seen in FIG. 15 a relatively rigid sheet 130 may be inserted between the folded halves of the last and uppermost sheet 28''' to prevent the remaining sheets from being drawn out of the opening 22 when one sheet is pulled from the last group of sheets after the number of remaining sheets decreases such that the entire group is apt to accompany the sheet being pulled by a user. Thus the very last thin and soft sheet 28''' is securely held in the container until it is intentionally pulled therefrom.

Although the invention has been described by referring to preferred embodiments thereof, it is not intended to limit the invention by the illustrated embodiments. It is intended to embrace all modifications and alterations within the scope of the invention as far as they are included in the broad aspect of the invention as defined in the appended claims.

What is claimed is:

1. In combination with a stack of folded and partially interleaved thin and soft sheets, a container holding the stack such that the sheets can be drawn one at a time from the container and that, after one sheet is drawn from the container, the next sheet is ready to be drawn from the container, the container having:

a bottom formed with two pairs of opposing lower flexible lugs together defining a discharge port consisting of a central discharge port and four blind port extensions extending obliquely towards four corners of the bottom of the container from the central discharge port and having respective rounded ends, the flexibility of the lugs being such that on pulling of the lowermost sheet of the stack down through the discharge port, first the sheet flexes down one of the lugs of one of the pairs, then both lugs of the other pair, and finally the other lug of the one pair, the stack of the sheets thus being supported normally by the two pairs of the lower flexible lugs and by at least two lugs at all times as the sheet is drawn out from the discharge port of the container; and two pairs of opposite side flaps forming respective upper flexible lugs each extending to the full extent of the associated side of the container and extending from said associated side towards said discharge port, the stack substantially resting on said upper flexible lugs, the upper flexible lugs guiding the sheets towards the discharge port as the sheet is drawn out from the container by way of said lower flexible lugs.

2. The container according to claim 1 wherein a rigid sheet is inserted in the fold of the uppermost sheet of the stack, whereby the uppermost sheet is securely held in the container until pulled therefrom.

3. The container according to claim 1 wherein said stack of sheet is piled in the container so as to rest on the upper flexible lugs so that the stack is curved downwardly convex whereby the weight of the stack of the sheets is substantially supported by the upper flexible lugs with a central portion of the stack substantially not resting on the lower flexible lugs.

4. The container according to claim 3 wherein a rigid sheet is inserted in the fold of the uppermost sheet of the stack, whereby the uppermost sheet is securely held in the container until pulled therefrom.

* * * * *